US005731735A

United States Patent [19]

Yokota et al.

[11] Patent Number: 5,731,735

[45] Date of Patent: Mar. 24, 1998

[54] POWER SUPPLY CIRCUIT FOR DRIVING AN INTEGRATED CIRCUIT, WHEREIN THE POWER SUPPLY IS ADJUSTED BASED ON TEMPERATURE SO THAT A DELAY VARIATION WITHIN THE IC ACCORDING TO TEMPERATURE MAY BE CANCELLED

[75] Inventors: Shinichi Yokota, Kita Saitama-gun; Toshiyuki Okayasu, Kita Katsushika-gun, both of Japan

[73] Assignee: Advantest Corporation, Tokyo, Japan

[21] Appl. No.: 697,249

[22] Filed: Aug. 21, 1996

[30] Foreign Application Priority Data

Aug. 25, 1995 [JP] Japan ..... 7-217145

[51] Int. Cl.[6] ..... G05F 1/10

[52] U.S. Cl. ..... 327/535; 327/262; 327/513; 327/540; 327/530; 323/907

[58] Field of Search ..... 327/262, 276, 327/283, 513, 538, 535, 540, 530; 323/907

[56] References Cited

U.S. PATENT DOCUMENTS 5,081,380 1/1992 Chen ..... 327/262
5,130,582 7/1992 Ishihara et al. ..... 307/591

*Primary Examiner*—Timothy P. Callahan
*Assistant Examiner*—Jung Ho Kim
*Attorney, Agent, or Firm*—Staas & Halsey

[57] ABSTRACT

In a power supply circuit for driving one IC chip on which first and second semiconductor circuit sections are formed integrally with each other as an IC, and wherein the first semiconductor circuit section has a delay circuit formed by an IC for giving a highly accurate delay time to a signal propagating through the delay circuit, and the delay time of the delay circuit varies with a change in the power consumption of the second semiconductor circuit section and a fluctuation in the power supply voltage which is supplied to the first semiconductor circuit section, there are provided a first power supply circuit for supplying an operating voltage to the first semiconductor circuit section and a second power supply circuit for supplying an operating voltage to the second semiconductor circuit section and for controlling to change the output voltage of the first power supply circuit. In response to a change in the power consumption of the second semiconductor circuit section, the second power supply circuit controls the output voltage of the first power supply circuit in such a manner as to cancel a variation in the delay time of the delay circuit of the first semiconductor circuit section which is caused by a temperature change.

7 Claims, 4 Drawing Sheets

POWER SUPPLY CIRCUIT FOR DRIVING AN INTEGRATED CIRCUIT, WHEREIN THE POWER SUPPLY IS ADJUSTED BASED ON TEMPERATURE SO THAT A DELAY VARIATION WITHIN THE IC ACCORDING TO TEMPERATURE MAY BE CANCELLED

TECHNICAL FIELD

The present invention relates to a power supply circuit for use in driving a semiconductor integrated circuit, which supplies an operating voltage (or operating current) to a semiconductor integrated circuit to drive it to an operating state and, more particularly, to such a power supply circuit which is capable of minimizing variations in the delay time of a delay circuit section of the semiconductor integrated circuit due to changes in temperature and/or power supply voltage.

BACKGROUND ART

In an IC testing apparatus (commonly called an IC tester) for testing a semiconductor integrated circuit (hereinafter referred to as an IC) such as for example, a semiconductor memory, various kinds of timing signals are needed to generate a test signal of a predetermined pattern which is applied to an IC undergoing a test (IC to be tested), various control signals and the like. To meet this requirement, the IC testing apparatus uses therein a timing signal generating circuit for generating various kinds of timing signals. The timing signal generating circuit is provided with a delay circuit which is generally composed of a number of delay elements connected in cascade and consisting of logical gate elements. The delay circuit is so configured that timing signals of desired delay times can be obtained from the junctions between two adjacent delay elements in the cascade-connected delay elements or from their output sides.

Heretofore, such a delay circuit composed of a large number of logical gate elements connected in cascade is formed by a TTL (Transistor-Transistor Logic) or ECL (Emitter-Coupled Logic). The delay circuit using TTL or ECL is hardly affected in its delay time for signal propagation by changes in temperature and/or fluctuations of voltage, and therefore, there is little problem about changes in temperature and/or fluctuations of voltage for delay circuits of this type.

In recent years, there has come into use as timing signal generating circuits for IC testing apparatus a delay circuit formed by an IC of MOS structure (MOS IC) with a view to minimize the power consumption of the delay circuit and to further enhance or improve the integration density of the IC. There has been previously known a delay circuit of the type in which a large number of logical gate elements connected in cascade are formed as an IC of a CMOS (complementary MOS) structure and signals having different delay times from one another are taken out from the junctions between two adjacent CMOS devices in the cascade-connected CMOS devices or from their output sides (see, for example, Japanese Patent Application No. 143950/1994 entitled "TIMING SIGNAL GENERATING CIRCUIT" filed by the same applicant as that of the present application).

The delay circuit formed by the MOS IC has a shortcoming that the delay time given to a signal propagating through the delay circuit (this delay time is also referred to as signal propagation delay time herein) varies relatively largely with a temperature change or voltage fluctuation. Therefore, it is impossible to generate highly accurate timing signals. If the timing signals cannot be generated with a high degree of accuracy, ICs to be tested cannot be tested with high accuracy. Hence, many methods and apparatus have been proposed to prevent the delay time of the delay circuit formed by the MOS IC from being affected by a temperature change or voltage fluctuation.

In general, the timing signal generating circuit having the delay circuit formed by the MOS IC is sometimes formed as one IC chip together with other circuits of the IC testing apparatus. FIG. 1 shows an example of the layout of IC on such IC chip, in which a first semiconductor circuit section 1 of the IC testing apparatus including the timing signal generating circuit and a second semiconductor circuit section 2 of the IC testing apparatus including other circuits such as logic circuits and the like are formed separately from each other on the one chip 3. The timing signal generating circuit has a delay circuit formed by the CMOS IC for providing a highly accurate signal propagation delay time. The first and second semiconductor circuit sections 1 and 2 are supplied with predetermined operating voltages from a common power supply circuit not shown.

In the IC chip 3 of such a construction as mentioned above, if the rate of operation or working ratio of the second semiconductor circuit section 2 varies so that its power consumption changes (increases or decreases), the calorific power or value in the second semiconductor circuit section 2 varies and accordingly its temperature changes. The temperature change of the second semiconductor circuit section 2 causes a change in the temperature of the first semiconductor circuit section 1 on the same chip 3 as well, and therefore, the CMOS IC forming the delay circuit in the first semiconductor circuit section 1 is affected by such temperature change, which results in a relatively large variation in the signal propagation delay time. Thus, a signal which propagates through the delay circuit cannot be delayed with high accuracy.

FIG. 2 is a graph showing how the delay time $\tau_1$ of the delay circuit in the first semiconductor circuit section 1 varies with a change in the power consumption $P_2$ of the second semiconductor circuit section 2 and accordingly a change in its temperature $T_1$. It can be seen from this graph that the delay time $\tau_1$ of the delay circuit formed by the CMOS IC in the first semiconductor circuit section 1 increases as the power consumption $P_2$ (and so temperature $T_1$) of the second semiconductor circuit section 2 increases.

Besides, the delay time $\tau_1$ of the delay circuit in the first semiconductor circuit section 1 varies even with a fluctuation in the operating voltage supplied thereto from the power supply circuit. FIG. 3 is a graph showing how the delay time $\tau_1$ of the delay circuit in the first semiconductor circuit section 1 varies with a fluctuation in the power supply voltage $E_1$. It is evident from this graph that the delay time $\tau_1$ of the delay circuit formed by the CMOS IC decreases with an increase in the power supply voltage $E_1$.

Prior power supply circuits which have been proposed to drive such ICs are constructed such that a common power supply circuit supplies an operating voltage to each of the first and second semiconductor circuit sections 1 and 2, or two power supply circuits supply separate operating voltages to the first and second semiconductor circuit sections 1 and 2, independently. Neither of these schemes takes it into account that the power supply circuit can be utilized in preventing the delay time $\tau_1$ of the delay circuit in the first semiconductor circuit section 1 from varying with a temperature change. Hence, the delay time of the delay circuit in the first semiconductor circuit section 1 is relatively significantly affected by the variations in temperature and power supply voltage, which makes it impossible to give the delay time with high accuracy to a signal which propagates the delay circuit.

SUMMARY OF THE INVENTION

It is therefore an object of the present invention to provide a power supply circuit for use in driving an IC which is capable of preventing to the utmost the delay time of a delay circuit formed by an IC from being affected by change in temperature.

According to the present invention there is provided a power supply circuit for driving one IC chip on which first and second semiconductor circuit sections are formed integrally with each other as an IC, the first semiconductor circuit section having a delay circuit formed by an IC for giving a highly accurate delay time to a signal propagating through the delay circuit, the delay time of the delay circuit varying with a change in the power consumption of the second semiconductor circuit section and a fluctuation in the power supply voltage which is supplied to the first semiconductor circuit section, and comprising a first power supply circuit for supplying an operating voltage to the first semiconductor circuit section and a second power supply circuit for supplying an operating voltage to the second semiconductor circuit section and for controlling to change the output voltage of the first power supply circuit. In response to a change in the power consumption of the second semiconductor circuit sections the second power supply circuit controls the output voltage of the first power supply circuit in such a manner as to cancel a variation in the delay time of the delay circuit of the first semiconductor circuit section which is caused by a change in temperature.

According to a first aspect of the present invention, the second power supply circuit includes a time constant circuit which has a time constant substantially equal to a temperature time constant of the first semiconductor circuit section corresponding to a time delay from the time at which a change in the power consumption of the second semiconductor circuit section has occurred to the time at which a change in the temperature of the first semiconductor circuit section has occurred. The second power supply circuit controls the output voltage of the first power supply circuit after delayed by a time interval corresponding to the time constant.

According to a second aspect of the present invention, the first power supply circuit includes a time constant circuit which has a time constant substantially equal to a temperature time constant of the first semiconductor circuit section corresponding to a time delay from the time at which a change in the power consumption of the second semiconductor circuit section has occurred to the time at which a change in the temperature of the first semiconductor circuit section has occurred. Upon receiving the power supply voltage from the second power supply circuit, the first power supply circuit changes its output voltage after delayed by a time interval corresponding to the time constant.

According to a third aspect of the present invention, a sensor is provided to detect the temperature of the IC chip, and the output from the sensor is used to control the output voltage of the first power supply circuit.

According to a fourth aspect of the present invention, the second power supply circuit comprises a transistor circuit which contains a transistor having its collector connected to a DC power supply and its emitter connected via a current-to-voltage converter to an output terminal of the second power supply circuit for supplying therefrom the power supply voltage to the second semiconductor circuit section, and a differential amplifier which amplifies a difference voltage between the power supply voltage from the output terminal of the second power supply circuit and a reference voltage, and supplies the amplified output voltage to the base of the transistor to control it such that the power supply voltage from the output terminal of the second power supply circuit becomes nearly equal to the reference voltage. The voltage converted by the current-to-voltage converter is fed to the first power supply circuit to control its output voltage.

According to a fifth aspect of the present invention, the second power supply circuit further comprises a low-pass filter which has a time constant substantially equal to the temperature time constant of the first semiconductor circuit section. This low-pass filter is placed at the output side of the current-to-voltage converter to the first power supply circuit.

According to a sixth aspect of the present invention, the first power supply circuit further comprises a low-pass filter which has a time constant substantially equal to the temperature time constant of the first semiconductor circuit section.

DETAILED DESCRIPTION OF THE PREFERRED EMBODIMENTS

Now, the embodiments of the power supply circuit for driving an IC according to the present invention will be described in detail, with reference to FIGS. 4 through 9. For the sake of brevity, the present invention will hereinafter be described as being applied to an IC testing apparatus. While a delay circuit of the timing signal generating circuit will be described to be formed by an MOS IC, in particular, CMOS IC, it is needless to say that the present invention is not limited specifically thereto.

Figure 1:
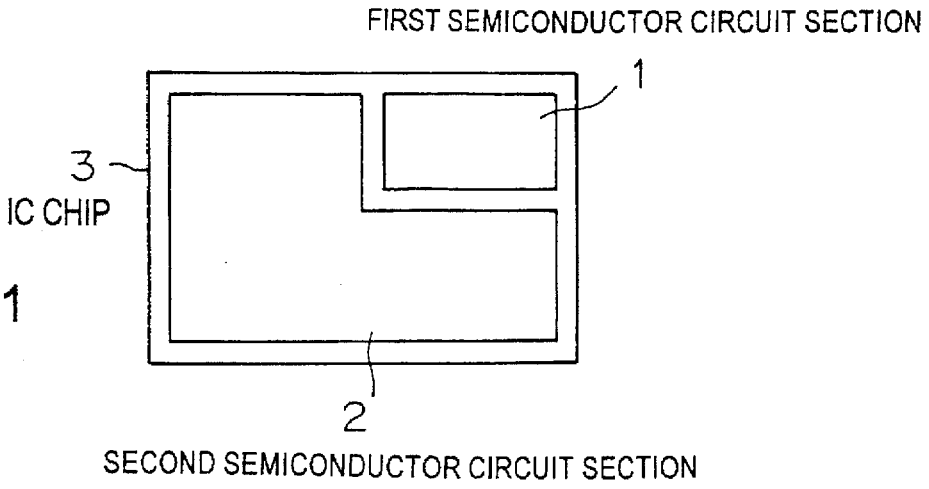
FIG. 1 is a schematic plan view illustrating an example of a layout of IC on one IC chip.
Figure 4:
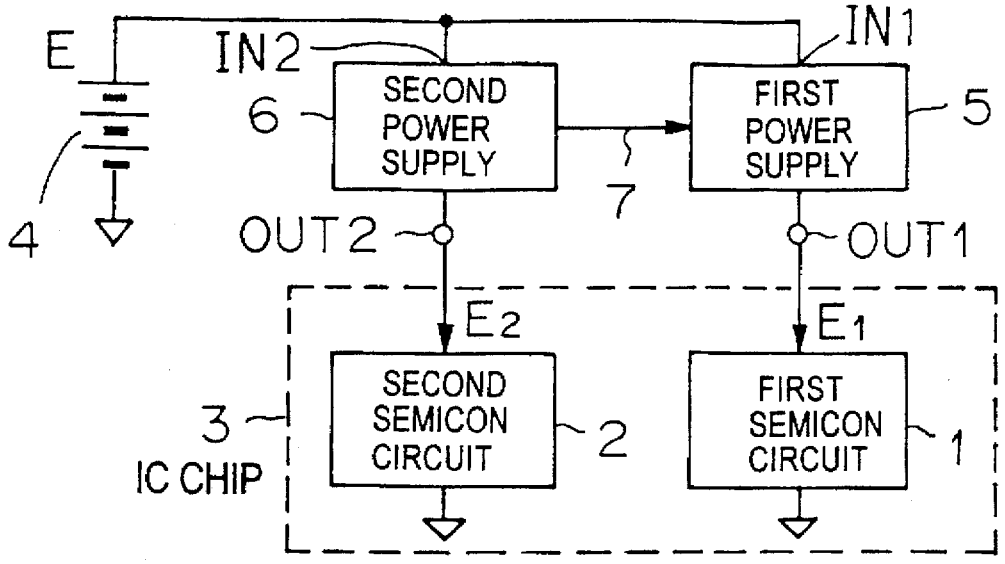
FIG. 4 is a block diagram showing a first embodiment of the power supply circuit for driving an IC according to the present invention.

FIG. 4 illustrates in block form a first embodiment of the power supply circuit for driving an IC according to the present invention. On an IC chip 3 that is driven by the power supply circuit are formed, as shown in FIG. 1, the first semiconductor circuit section 1 including a timing signal generating circuit provided with a delay circuit formed by a CMOS IC for providing a signal propagation delay time with high accuracy and the second semiconductor circuit section 2 including other circuits such as logic circuits and the like.

In the present invention, the power supply circuit for driving the IC chip 3 is separated into a first power supply circuit 5 for driving the first semiconductor circuit section 1 including the delay circuit and a second power supply circuit 6 for driving the second semiconductor circuit section 2 including another circuits such as logic circuits, and moreover the power supply circuit is so arranged that the second power supply circuit 6 is also used to control the first power supply circuit 5 via control signal line 7 to change the power supply voltage $E_1$ of the first power supply circuit 5. The control by the second power supply circuit 6 is one that when the delay time of the delay circuit in the first semiconductor circuit section 1 varies with a change in temperature of the second semiconductor circuit section 2 caused by a change in its power consumption $P_2$, the power supply voltage $E_1$ from the first power supply circuit 5 which is supplied to the first semiconductor circuit section 1 is varied in a direction that the variation in the delay time of the delay circuit of the first semiconductor circuit section 1 can be canceled. In other words, the second power supply circuit 6 controls the power supply voltage $E_1$ of the first power supply circuit 5 in such a manner as to cancel the delay time variation of the delay circuit of the first semiconductor circuit section 1 which is caused in accordance with the change in the power consumption $P_2$ of the second semiconductor circuit section 2.

Figure 2:
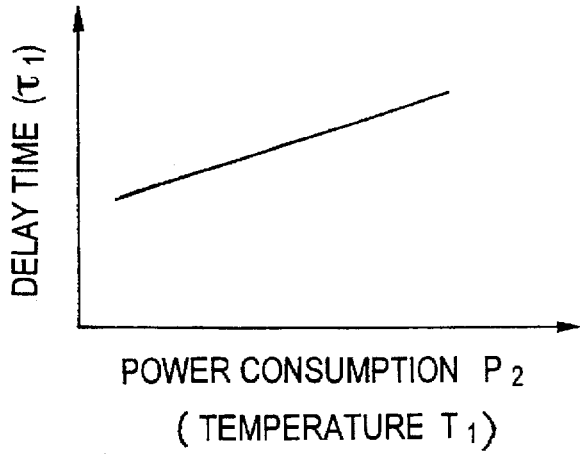
FIG. 2 is a characteristic diagram showing the relationship between the delay time $\tau_1$ of a delay circuit included in a first semiconductor circuit section and the power consumption $P_2$ of a second semiconductor circuit section in the IC depicted in FIG. 1.
Figure 3:
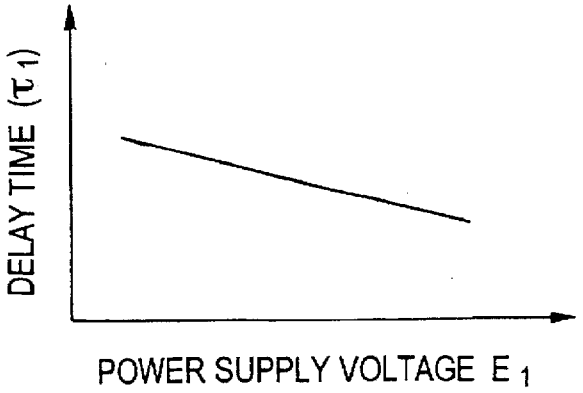
FIG. 3 is a characteristic diagram showing the relationship between the delay time $\tau_1$ of the delay circuit included in the first semiconductor circuit section and the power supply voltage $E_1$ in the IC depicted in FIG. 1.

As described before with reference to the conventional power supply circuit for driving an IC, when the power consumption $P_2$ of the second semiconductor circuit section 2 varies and hence the temperature $T_1$ thereof varies, the delay time $\tau_1$ of the delay circuit formed by a CMOS IC varies as shown in FIG. 2, and also when the operating voltage $E_1$ supplied from the first power supply circuit 5 to the first semiconductor circuit section 1 changes, the delay time $\tau_1$ of the delay circuit varies as shown in FIG. 3.

Therefore, according to the first embodiment of the present invention, when the delay time $\tau_1$ of the delay circuit in the first semiconductor circuit section 1, for example, increases with an increase in the temperature of the second semiconductor circuit section 2 due to an increase in the power consumption $P_2$ thereof, the power supply voltage $E_1$ from the first power supply circuit 5 which is supplied to the first semiconductor circuit section 1 is increased. Consequently, the delay time $\tau_1$ of the delay circuit decreases as shown in FIG. 3. Hence, an increase in the delay time $\tau_1$ of the delay circuit due to a rise in temperature of the second semiconductor circuit section 2 can be canceled by increasing the power supply voltage $E_1$ from the first power supply circuit 5 which is supplied to the first semiconductor circuit section 1. Thus, a desired delay time can be given to the signal which propagates through the delay circuit with high accuracy and a desired timing signal can be obtained with high accuracy.

Figure 5:
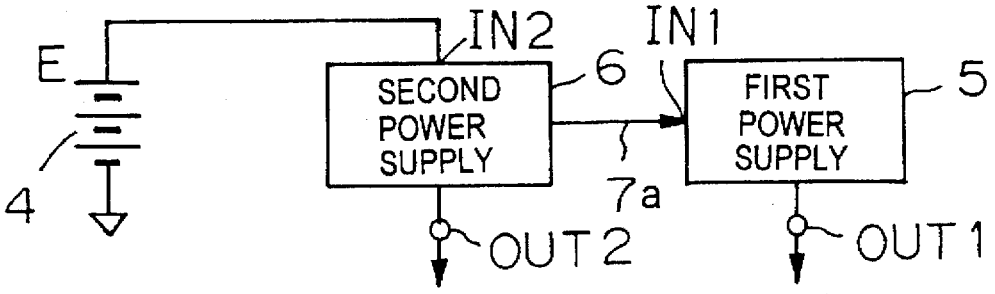
FIG. 5 is a block diagram showing a second embodiment of the power supply circuit for driving an IC according to the present invention.

While in the first embodiment shown in FIG. 4, the voltage $E_1$ is supplied from a DC power source 4 to input terminals IN1 and IN2 of the first and second power supply circuits 5 and 6 and the power supply voltages (operating voltages) $E_1$ and $E_2$ are supplied from output terminals OUT and OUT2 of the first and second power supply circuits 5 and 6 to the corresponding first and second semiconductor circuit sections 1 and 2, respectively, it is also possible to employ a configuration in which the voltage E is supplied from the DC power source 4 to the second power supply circuit 6 alone and a predetermined DC voltage is supplied from the second power supply circuit 6 to the input terminal IN1 of the first power supply circuit 5 via a control signal line 7*a* which is also used as a power source line as in a second embodiment of the present invention shown in FIG. 5.

Figure 6:
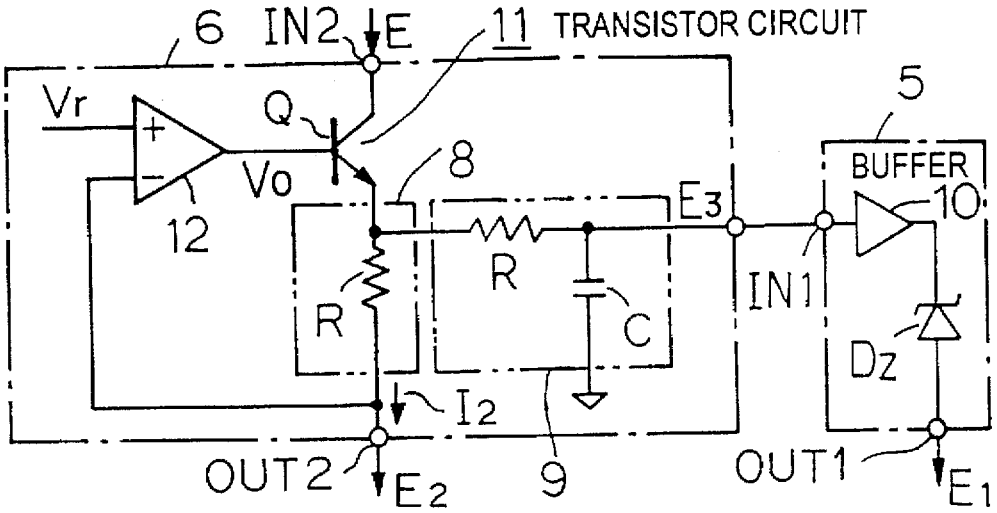
FIG. 6 is a circuit diagram showing an operative specific example of the second embodiment shown in FIG. 5.

FIG. 6 illustrates specific or concrete examples of the first and second power supply circuits 5 and 6 used in the second embodiment. The second power supply circuit 6 comprises a transistor circuit 11 containing an npn-type transistor Q, a differential amplifier 12, a current-to-voltage (current/voltage) converter 8 and a low-pass filter (LPF) 9 composed of a resistor R and a capacitor C. The transistor Q has its collector connected to the input terminal IN2 of the second power supply circuit 6, its emitter connected to the input port of the current/voltage converter 8 as well as the input port of the low-pass filter 9, and its base connected to the output port of the differential amplifier 12. The output port of the current/converter 8 is connected to the output terminal OUT2 of the second power supply circuit 6 and the—(minus) input port of the differential amplifier 12.

With the above configuration, the application of the DC voltage E from the power source 4 to the collector of the transistor Q causes an emitter current to flow since the transistor Q is held in conductive state by a base bias voltage $V_0$. The emitter current is fed to the output terminal OUT2 of the second power supply circuit 6 through the current/voltage converter (consisting of a resistor R in this example) 8 where it is converted into a voltage. The voltage thus converted is provided as a power supply voltage $E_3$ to the input terminal IN1 of the first power supply circuit 5 via the low-pass filter 8. In this instance, the current to the first power supply circuit 5 via the low-pass filter 9 is negligibly small because a buffer circuit 10 of the first power supply circuit 6 has a very high input impedance, and consequently, the emitter current mostly flows to the output terminal OUT2 via the current/voltage converter 8. This current flowing to the output terminal OUT2 will hereinafter be referred to as an emitter current $I_2$.

Since the differential amplifier 12 has its + (plus) input port supplied with a reference voltage $V_r$, it amplifies the difference voltage ($V_r$–$E_2$) between the reference voltage $V_r$ and the voltage supplied to the—input port or the power supply voltage $E_2$ from the second power supply circuit 6, and applies via its output port the amplified output as the bias voltage $V_0$ to the base of the transistor Q. Since the gain of the differential amplifier 12 is very large, the power supply voltage $E_2$ from the second power supply circuit 6 can be controlled to have a fixed value substantially equal to the reference voltage $V_r$ by a feedback circuit composed of the transistor Q, the current/voltage converter 8, and the differential amplifier 12.

Next, the above-described control operation of the second power supply circuit 6 will be described concretely.

Now, letting the gain of the differential amplifier 12 be represented by A, the following equation is given.

$$(V_r-E_2)A=V_0 \quad (1)$$

Letting the base-emitter voltage be represented by $V_{be}$, the emitter voltage $V_e$ is given as follows:

$$V_e = V_0 - V_{be} = (V_r - E_2)A - V_{be} \quad (2)$$

Letting the input impedance of the current/voltage converter 8 be represented by Z (Z=R in this example), the voltage $I_2Z$ at the input port thereof is given as follows:

$$I_2Z = V_e - E_2 = (V_r - E_2)A - V_{be} - E_2 = V_rA - E_2(A+1) - V_{be} \quad (3)$$

Letting the overall load impedance of the second semiconductor circuit section 2 be represented by $Z_2$, $$E_2 = Z_2I_2 \quad (4)$$

Substitution of Eq. (4) into Eq. (3) gives the following equation:

$$I_2Z = V_rA - Z_2I_2(A+1) - V_{be}$$

Therefore, $$I_2 = (V_rA - V_{be})/\{(Z + Z_2)A + 1)\} = (V_r - V_{be}/A)/\{Z/A + Z_2(1 + 1/A)\} \quad (5)$$

Since the gain A of the differential amplifier 12 is very large as mentioned above, it can be regarded that $V_{be}/A \approx 0$, $Z/A \approx 0$, and $1/A \approx 0$.

Thus, $$I_2 \approx V_r/Z_2$$

Therefore, $$V_r \approx I_2Z_2 \approx E_2 \quad (6)$$

From Eq. (6) it will be seen that the power supply voltage (output voltage) $E_2$ from the second power supply circuit 6 is controlled to become a voltage which is nearly equal to the reference voltage $V_r$.

The power consumption $P_2$ of the second semiconductor circuit section 2 is given as follows:

$$P_2 = E_2I_2 \approx V_rI_2 \quad (7)$$

Hence, the power consumption $P_2$ is substantially proportional to the emitter current $I_2$.

On the other hand, the emitter current $I_2$ is converted by the current/voltage converter 8 into a voltage, which is filtered by the low-pass filter 9 and is then output as a voltage $E_3$ from the second power supply circuit 6. The voltage $E_3$ is, in this example, equal to the emitter voltage $V_e$ DC-wise. Therefore, the following equation is given.

$$E_3 = V_e = ZI_2 + E_2 \approx ZI_2 + V_r \approx ZP_2/V_r + V_r \quad (8)$$

Eq. (8) indicates that the power supply voltage $E_3$, which varies with the power consumption $P_2$ of the second semiconductor circuit section 2, is supplied to the first power supply circuit 5 composed of the buffer circuit 10 and a Zener diode Dz. In consequence, the power supply voltage $E_1$ of the first power supply circuit 5 is given by the following equation, letting a voltage drop in the Zener diode Dz be represented by $V_z$:

$$E_1 = E_3 - V_z = ZP_2/V_r + V_r - V_z \quad (9)$$

Figure 7:
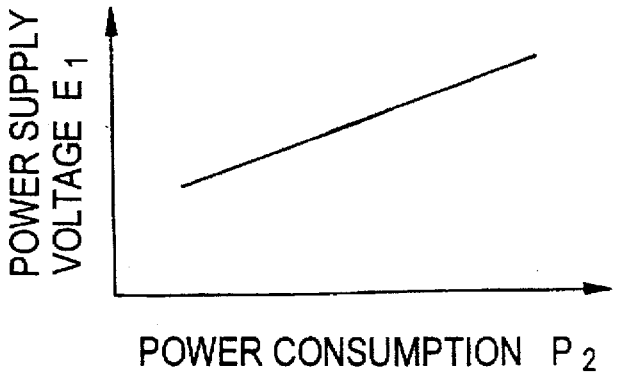
FIG. 7 is a characteristic diagram showing the relationship between the output voltage $E_1$ from a first power supply circuit 5 and the power consumption $P_2$ of the second semiconductor circuit section 2 in the embodiments shown in FIGS. 4 and 5.

Hence, the power supply voltage $E_1$ from the first power supply circuit 5 varies with the power consumption $P_2$ of the second semiconductor circuit section 2 as shown in FIG. 7. It will be seen from FIG. 7 that an increase in the power consumption $P_2$ of the second semiconductor circuit section 2, for instance, causes a proportional increase in the power supply voltage $E_1$ from the first power supply circuit 5, whereas a decrease in the power consumption $P_2$ of the second semiconductor circuit section 6 causes a proportional decrease in the power supply voltage $E_1$ of the first power supply circuit 5.

Thus, when the power supply (output) voltage $E_1$ of the first power supply circuit 5 becomes high (or low) in accordance with an increase (or decrease) in the power consumption $P_2$ of the second semiconductor circuit section 6, the delay time $\tau_1$ of the delay circuit in the first semiconductor circuit section 1 decreases (or increases) as shown in FIG. 3, and hence the increment (or decrement) in the delay time $\tau_1$ caused by an increase (or decrease) in the power consumption $P_2$ can be canceled.

Here, there exists some time delay $\tau_d$ between the time when the power consumption $P_2$ of the second semiconductor circuit section 2 increases (or decreases) by $\Delta P_2$ and the time when the temperature $T_1$ of the first semiconductor circuit section 1 rises (or drops) by $\Delta T_1$ and also the delay time $\tau_1$ of the delay circuit increases (or decreases) by $\Delta\tau_1$. It is therefore desirable that the second power supply circuit 6 control the powers supply voltage $E_1$ of the first power supply circuit 5 with a time constant nearly equal to a temperature time constant corresponding to the time delay $\tau_d$ in the first semiconductor circuit section 1. To perform this, in this embodiment, the low-pass filter 9 is inserted in the second power supply circuit 6, by which a time constant substantially equal to the temperature time constant corresponding to the time delay $\tau_d$ in the first semiconductor circuit section 1 is given to the power supply voltage $E_3$ to be fed to the first power supply circuit 5 so that the power supply voltage $E_3$ is supplied to the first power supply circuit 5 after delayed substantially by $\tau_d$. The buffer circuit 10 in the first power supply circuit 5 is a buffer (a voltage follower circuit) having a gain of 1 and is provided to cause the first power supply circuit 5 to possess a current supply capacity as a voltage source.

The same results as described above could also be obtained by a configuration in which the low-pass filter 9 inserted in the second power supply circuit 6 is connected to the input side of the first power supply circuit 5 (the preceding stage or the subsequent stage of the buffer circuit 10, for instance), the output voltage from the current/voltage converter 8 is applied as it is to the first power supply circuit 5 as the power supply voltage $E_3$ from the second power supply circuit 6, and a time constant substantially equal to the temperature time constant in the first semiconductor circuit section 1 is given by the low-pass filter to the power supply voltage $E_3$ fed to the first power supply circuit 5 thereby varying the output voltage $E_1$ after delayed substantially by $\tau_d$.

Figure 8:
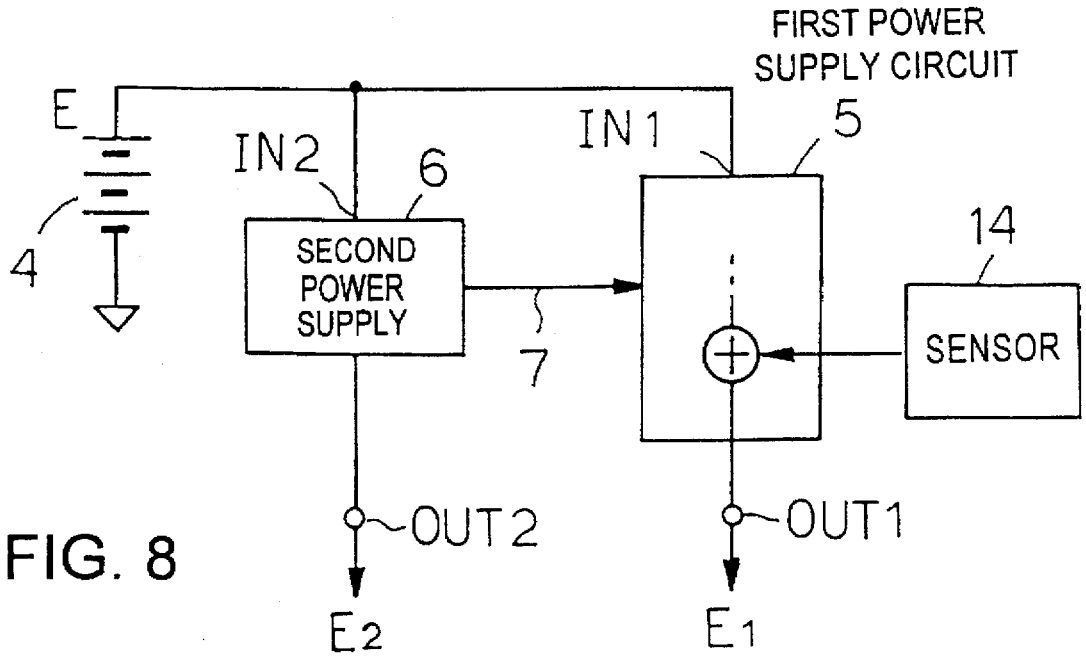
FIG. 8 is a block diagram showing a third embodiment of the power supply circuit for driving an IC according to the present invention.
Figure 9:
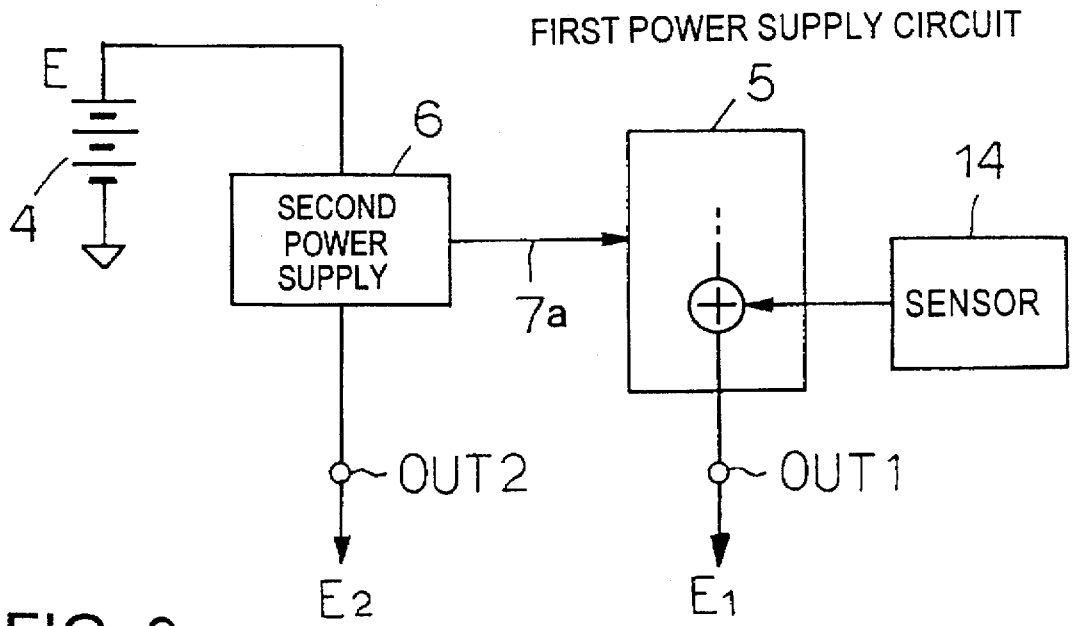
FIG. 9 is a block diagram showing a fourth embodiment of the power supply circuit for driving an IC according to the present invention.

In addition, it is possible to compensate for the time delay $\tau_d$ in the delay circuit of the first semiconductor circuit section 1 with high accuracy if there is provided a temperature sensor 14 for detecting the temperature of the IC chip 3 and the output of the sensor 14 is fed to the first power supply circuit 5 shown in FIG. 4 or FIG. 5 to further control and hence finely adjust the output voltage $E_1$ of the first power supply circuit 5 by the sensor output. FIG. 8 illustrates a third embodiment of the present invention in which the temperature sensor 14 is added in the first embodiment shown in FIG. 4. Also, FIG. 9 illustrates an example in which the temperature sensor 14 is added in the second embodiment shown in FIG. 5. While the both embodiments are adapted to correct the power supply voltage output from the first power supply circuit 5 by the output signal from the temperature sensor 14, the voltage to be input into the first power supply circuit 5 may also be corrected by the output signal from the temperature sensor 14.

Although in each of the above embodiments the delay circuit of the first semiconductor circuit section 1 has been formed by a CMOS IC, it is needless to say that the present invention is also applicable to a power supply circuit in which the delay circuit is formed by a MOS IC or some other IC other than MOS IC and the same functional effects as described above are obtained.

In the case where the IC forming the delay circuit exhibits characteristics inverse to the power consumption $P_2$ versus delay time $\tau_1$ characteristic shown in FIG. 2 and the power supply voltage $E_1$ versus delay time $\tau_1$ characteristic shown in FIG. 3 (where an increase in the power consumption $P_2$ causes the delay time $\tau_1$ to be decreased and an increase in the power supply voltage $E_1$ causes the delay time $\tau_1$ to be increased), the power supply voltage $E_1$ of the first power supply circuit 5 will be controlled to obtain a characteristic inverse to the power consumption $P_2$ versus power supply voltage $E_1$ characteristic shown in FIG. 7. Such control can be effected by, for example, using a pnp-type transistor as the transistor Q of the transistor circuit 11 in FIG. 6.

Further, the "delay circuit" mentioned herein includes every circuit from which the input signal thereinto is output with a predetermined time delay even they are not referred to as delay circuit.

EFFECT OF THE INVENTION

As is apparent from the above, the power supply circuit for driving an IC according to the present invention is equipped with the first and second power supply circuits 5 and 6 for individually supplying operating voltages to the first semiconductor circuit section 1 containing the delay circuit formed by an IC for providing a high accuracy delay time and the second semiconductor circuit section 2 containing other circuits such as logic circuits and the like, and the second power supply circuit 6 is used to vary the operating voltage of the first power supply circuit 5 in accordance with a change in the power consumption $P_2$ of the second semiconductor circuit section 2, thereby canceling a variation in the delay time of the delay circuit caused by a temperature change of the first semiconductor circuit section 1. Thus, there is obtained a remarkable advantage in the present invention that the delay time variation of the first semiconductor circuit section 1 due to its temperature change can be greatly reduced.

It will be apparent that many modifications and variations to the embodiments of the present invention described above may be made without departing from the novel concept and scope of the invention.

What is claimed is:

1. A power supply circuit for use in driving one semiconductor integrated circuit chip on which first and second semiconductor circuit sections are formed integrally with each other as a semiconductor integrated circuit, said first semiconductor circuit section having a delay circuit formed by a semiconductor integrated circuit for giving a highly accurate delay time to a signal propagating through said delay circuit, said delay time of the delay circuit varying with a change in the power consumption of said second semiconductor circuit section and a fluctuation in the power supply voltage which is supplied to said first semiconductor circuit section, said power supply circuit comprising:

a first power supply circuit for supplying an operating voltage to said first semiconductor circuit section; and a second power supply circuit for supplying an operating voltage to said second semiconductor circuit section and for controlling to change the output voltage from said first power supply circuit;

wherein said second power supply circuit controls, in response to a change in the power consumption of said second semiconductor circuit section, the output voltage from said first power supply circuit in such a manner as to cancel a variation in the delay time of said delay circuit of said first semiconductor circuit section, said variation in the delay time being caused by a change in temperature.

2. The power supply circuit according to claim 1, wherein said second power supply circuit includes a time constant circuit which has a time constant substantially equal to a temperature time constant of said first semiconductor circuit section corresponding to a time delay from the time at which a change in the power consumption of said second semiconductor circuit section has occurred to the time at which a change in the temperature of said first semiconductor circuit section has occurred so that said second power supply circuit controls the output voltage of said first power supply circuit after delayed by a time interval corresponding to said time constant.

3. The power supply circuit according to claim 1, wherein said first power supply circuit includes a time constant circuit which has a time constant substantially equal to a temperature time constant of said first semiconductor circuit section corresponding to a time delay from the time at which a change in the power consumption of said second semiconductor circuit section has occurred to the time at which a change in the temperature of said first semiconductor circuit section has occurred so that, when the power supply voltage is supplied from said second power supply circuit, said first power supply circuit changes its output voltage after delayed by a time interval corresponding to said time constant.

4. The power supply circuit according to claim 1, further comprising a sensor for detecting the temperature of said semiconductor integrated circuit chip, and wherein the output from said sensor is used to control the output voltage of said first power supply circuit.

5. The power supply circuit according to claim 1, wherein said second power supply circuit comprises:

a transistor circuit which contains a transistor having its collector connected to a DC power supply and its emitter connected via a current-to-voltage converter to an output terminal of said second power supply circuit for supplying therefrom the power supply Voltage to said second semiconductor circuit section; and a differential amplifier which amplifies a difference voltage between the power supply voltage from the output terminal of said second power supply circuit and a reference voltage, and supplies the amplified output voltage to the base of said transistor to control it such that the power supply voltage from the output terminal of said second power supply circuit becomes nearly equal to said reference voltage; and wherein the voltage converted by said current-to-voltage converter is fed to said first power supply circuit to control its output voltage.

6. The power supply circuit according to claim 5, wherein said second power supply circuit further comprises a low-pass filter which has a time constant substantially equal to the temperature time constant of said first semiconductor circuit section, said low-pass filter being placed at the output side of said current-to-voltage converter to said first power supply circuit.

7. The power supply circuit according to claim 5, wherein said first power supply circuit further comprises a low-pass filter which has a time constant substantially equal to the temperature time constant of said first semiconductor circuit section.

* * * * *